US006206204B1

(12) United States Patent
Aikawa

(10) Patent No.: US 6,206,204 B1
(45) Date of Patent: Mar. 27, 2001

(54) SCREEN APPARATUS

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 0 days.

(21) Appl. No.: 09/175,347

(22) Filed: Oct. 20, 1998

(30) Foreign Application Priority Data

Apr. 16, 1998 (JP) ..... 10-106760
Jun. 2, 1998 (JP) ..... 10-152650

(51) Int. Cl.[7] ..... B07B 1/20

(52) U.S. Cl. ..... 210/414; 210/413; 210/485; 210/497.01; 210/499; 162/55; 209/273; 209/305; 209/306

(58) Field of Search ..... 162/55; 209/273, 209/305, 306; 210/413, 414, 485, 497.01, 498, 499

(56) References Cited

U.S. PATENT DOCUMENTS 4,067,800 * 1/1978 Young ..... 209/273
5,096,127 * 3/1992 Young ..... 209/273
5,318,186 * 6/1994 Reienecker ..... 209/273
5,605,234 * 2/1997 Aikawa ..... 209/411

* cited by examiner

*Primary Examiner*—David A. Reifsnyder
(74) *Attorney, Agent, or Firm*—Kanesaka & Takeuchi

(57) ABSTRACT

A screen apparatus of the invention is provided with a tank for receiving a papermaking material; a screen situated inside the tank for dividing the tank into a first chamber and a second chamber to separate a foreign substance from the papermaking material; a first supply passage for supplying the papermaking material into the tank; a second supply passage for supplying the papermaking material into the tank; a stirring member disposed between an inner wall of the tank and the screen to stir the papermaking material introduced in the first chamber; a screened papermaking material discharge passage communicating with the second chamber for discharging a screened papermaking material outside the tank; and a foreign substance discharge passage communicating with the first chamber for discharging a foreign substance outside the tank. The first supply passage includes a first supply inlet located at an upper side of the tank, and the second supply passage includes a second supply inlet located lower than the first supply inlet. The papermaking material can be effectively separated by the screen.

8 Claims, 9 Drawing Sheets

SCREEN APPARATUS

BACKGROUND OF THE INVENTION AND RELATED ART STATEMENT

The present invention relates to a screen apparatus, and more particularly, to a screen apparatus which can improve a processing amount and an effect of separating good fibers and foreign substances.

Conventionally, in the screen apparatus, a papermaking material received in a tank is stirred by a stirring member, and foreign substances in the papermaking material is removed through a screen to thereby screen or select the papermaking material.

However, as it approaches a lower part of the tank, that is, in a downstream side in the flow of the papermaking material, the papermaking material is condensed.

As a result, there have been problems. Namely, as a flow distance of the papermaking material in the tank from a supply inlet for the papermaking material to the screen becomes longer, a material passing resistance through the screen due to concentration or condensation of the papermaking material is increased, so that the processing amount is lowered. Also, since clogging of the screen is liable to occur, an effect of separating foreign substances and good fibers is lowered.

An object of the invention is to provide a screen apparatus which can obviate the aforementioned problems.

Further objects and advantages of the invention will be apparent from the following description of the invention.

SUMMARY OF THE INVENTION

To achieve the above object, the present invention provides a screen apparatus including a tank for receiving a papermaking material; a screen for dividing the tank into a first chamber and a second chamber and separating a foreign substance from the papermaking material; a first supply passage for supplying the papermaking material into the tank and including a first supply inlet located at an upper side of the tank; a second supply passage for supplying the papermaking material into the tank and including a second supply inlet located lower than the first supply inlet; a stirring member disposed between an inner wall of the tank and the screen and stirring the papermaking material in the first chamber; a screened papermaking material discharge passage communicating with the second chamber and leading the papermaking material screened by the screen to an outside of the tank; and a foreign substance discharge passage communicating with the first chamber and leading the foreign substance, which does not pass through the screen, to the outside of the tank.

Since the papermaking material is supplied to the lower part of the screen as well as the upper part of the screen, the condensation or thickening of the papermaking material at the lower part is avoided.

In the screen apparatus of the invention, the first supply inlet may be located higher than the openings provided at an uppermost part of the screen. Also, the second supply inlet may be located lower than the openings provided at a lowermost part of the screen. Since the first and second supply inlets are not opposed to the openings of the screen, the screen is not damaged by the papermaking material with the foreign substance ejecting thereto.

Further, preferably, a foreign substance discharge outlet of the foreign substance discharge passage may be located between the first supply inlet and the second supply inlet.

Also, an upper projecting member may be disposed circularly above the foreign substance discharge outlet to project from an inner wall of the tank, and a lower projecting member may be disposed circularly below the foreign substance discharge outlet to project from the inner wall of the tank. As a result, the foreign substance can be discharged easily and smoothly.

DETAILED DESCRIPTION OF PREFERRED EMBODIMENTS

A screen apparatus of an embodiment of the present invention is explained with reference to the drawings.

Figure 1:
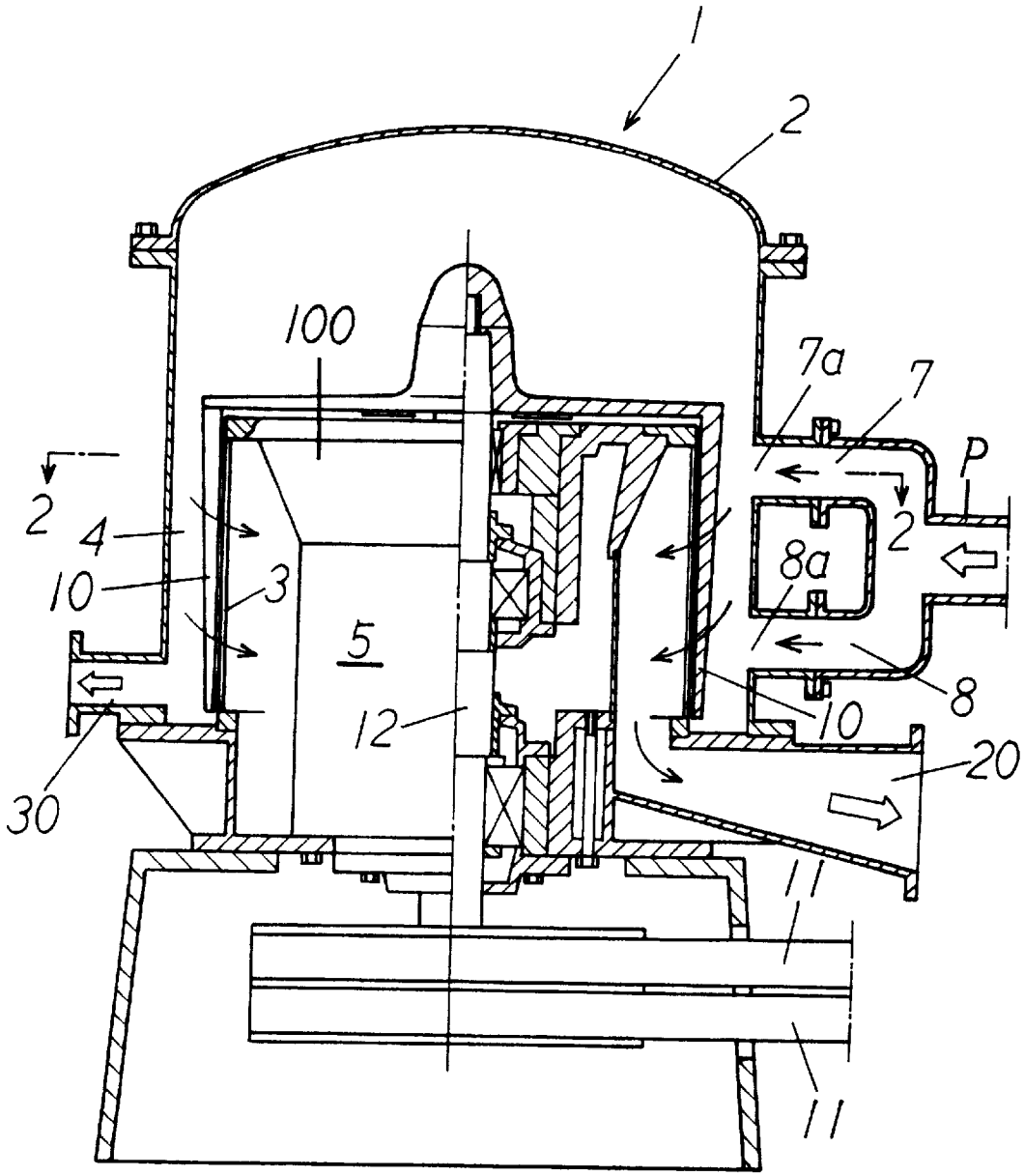
FIG. 1 is a schematic sectional view showing a screen apparatus of an embodiment according to the present invention.

In FIG. 1, numeral 1 designates a screen apparatus, and the screen apparatus 1 is an apparatus for screening or removing foreign substances, such as plastic, from a papermaking material, i.e. old newspaper, old cardboard paper, or the like. More specifically, the screen apparatus 1 is a so-called inward type screen apparatus (centripetal type in which a stirring member 10 rotates outside a screen 3 described later), wherein the papermaking material flows from an outside of the screen toward an inside thereof to be screened.

The screen apparatus 1 includes a tank 2 for receiving the papermaking material. The tank 2 is divided into a first chamber 4 and a second chamber 5 by the screen 3 for separating foreign substances contained in the papermaking material. The screen 3 has, for example, a substantially cylindrical shape, wherein an upper surface thereof is closed and a lower surface thereof is opened, and includes openings 3a in the shape of a round hole or slit on the side surface thereof. The screen 3 is supported by a support cylinder 100 with a bearing.

Numeral 7 designates a first supply passage. The first supply passage 7 supplies the papermaking material to the tank 2, and includes a first supply inlet 7*a* located at an upper side of the tank 2.

Numeral 8 designates a second supply passage. The second supply passage 8 supplies the papermaking material to the tank 2, and includes a second supply inlet 8a located lower than the first supply inlet 7*a* in the tank 2.

It is arranged that from the first supply passage 7 and the second supply passage 8, for example, a papermaking material with a concentration of approximately 1% is supplied into the tank 2. The first supply passage 7 and the second supply passage 8 are branched from a main supply passage P.

Also, the stirring member 10 is provided between an inner wall of the tank 2 and the screen 3. The stirring member 10 stirs the papermaking material in the first chamber 4, and at the same time, applies a positive pressure against the screen 3 in a front part of the stirring member 10, and a negative pressure against the screen 3 in a rear part of the stirring member 10, so that the stirring member 10 performs a screen cleaning operation for removing papermaking materials clogged in the screen 3.

The stirring member 10 is rotated by a motor, not shown, through belts 11 and a rotary shaft 12.

Numeral 20 designates a screened papermaking material discharge passage. The screened papermaking material discharge passage 20 communicates with the second chamber 5, and leads the papermaking material screened by the screen 3 to the outside of the tank 2.

Numeral 30 designates a foreign substance discharge passage. The foreign substance discharge passage 30 communicates with the first chamber 4, and leads the foreign substances contained in the papermaking material, which do not pass through the screen 3, to the outside of the tank 2.

Therefore, the papermaking material is supplied to the tank 2 through the first supply passage 7 and the second supply passage 8, and the papermaking material in the first chamber 4 is stirred by the stirring member 10. Foreign substances, such as plastics, contained in the papermaking material can not pass through the screen 3, and are stored in the first chamber 4. The papermaking material which passes through the screen 3 is led to the outside of the tank 2 through the screened papermaking material discharge passage 20.

In operating the screen apparatus 1, an open degree of a valve, not shown, which opens and closes the foreign substance discharge passage 30, is adjusted such that the valve is opened continuously, or the valve is intermittently opened and closed, to thereby lead the foreign substances, which can not pass through the screen 3, to the outside of the tank 2 through the foreign substance discharge passage 30.

Conventionally, as it approaches the lower part of the tank 2, that is, as the flow of the papermaking material approaches the downstream side, the papermaking material is condensed or thickened, so that the material passing resistance through the screen due to the condensation of the papermaking material is increased to lower the processing amount. Also, since clogging of the screen is liable to occur, the effect of separating the foreign substances and the good fibers is lowered.

However, according to the screen apparatus 1 of the invention, the supply passage for supplying the papermaking material to the tank 2 is provided plurally as the first supply passage 7 and the second supply passage 8, and moreover, the second supply inlet 8a of the second supply passage 8 into the tank 2 is positioned lower than the first supply inlet 7*a* of the first supply passage 7 into the tank 2, resulting in that the distance of the flow of the papermaking material from the supply inlet for the papermaking material into the tank to the screen becomes short, to thereby reduce the papermaking material from being condensed.

As a result, the condensation of the papermaking material passing through the screen 3 becomes low, and the material passing resistance of the screen is lowered, so that the papermaking material passing through the screen is increased to thereby improve the processing amount. Also, since the concentration or condensation of the papermaking material passing through the screen 3 is low, clogging of the screen 3 is reduced, to thereby improve the separation effect of the foreign substances and the good fibers.

Further, although the first supply passage 7 and the second supply passage 8 are provided as the passages for supplying the papermaking material in the embodiment, in accordance with a kind of the papermaking material, a proportion of the foreign substances contained in the papermaking material, a size of the tank or the like, an adequate number of supply inlets may be provided so as to communicate with an intermediate position between the first supply inlet 7*a* and the second supply inlet 8*a*.

Figure 3:
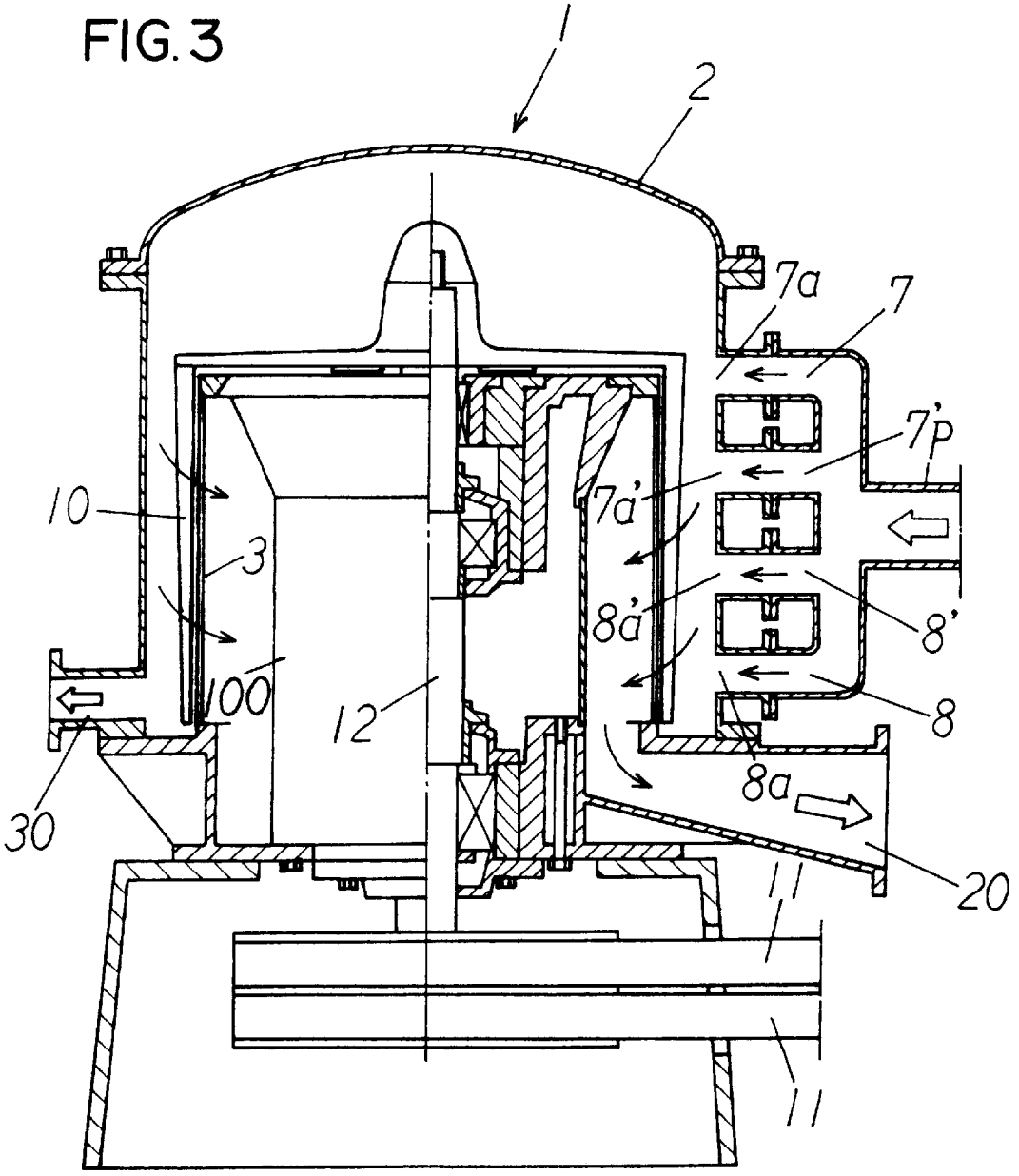
FIG. 3 is a schematic sectional view of a screen apparatus of a different embodiment of the invention.

For example, as shown in FIG. 3, between the first supply inlet 7*a* and the second supply inlet 8*a*, there are disposed a third supply passage 7' with a third supply inlet 7*a*' and a fourth supply passage 8' with a fourth supply inlet 8*a*'.

Figure 2:
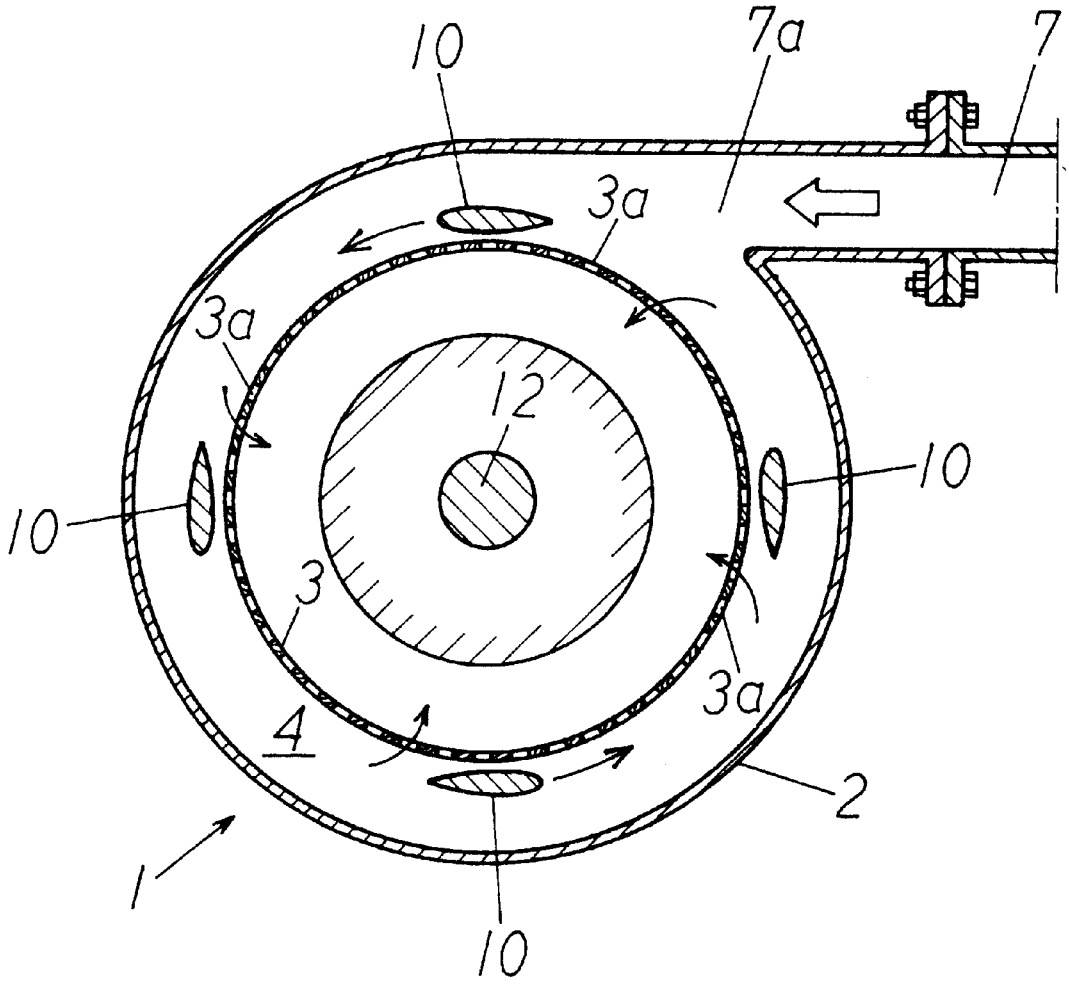
FIG. 2 is a schematic cross sectional view of the screen apparatus taken along line 2—2 in FIG. 1.
Figure 4:
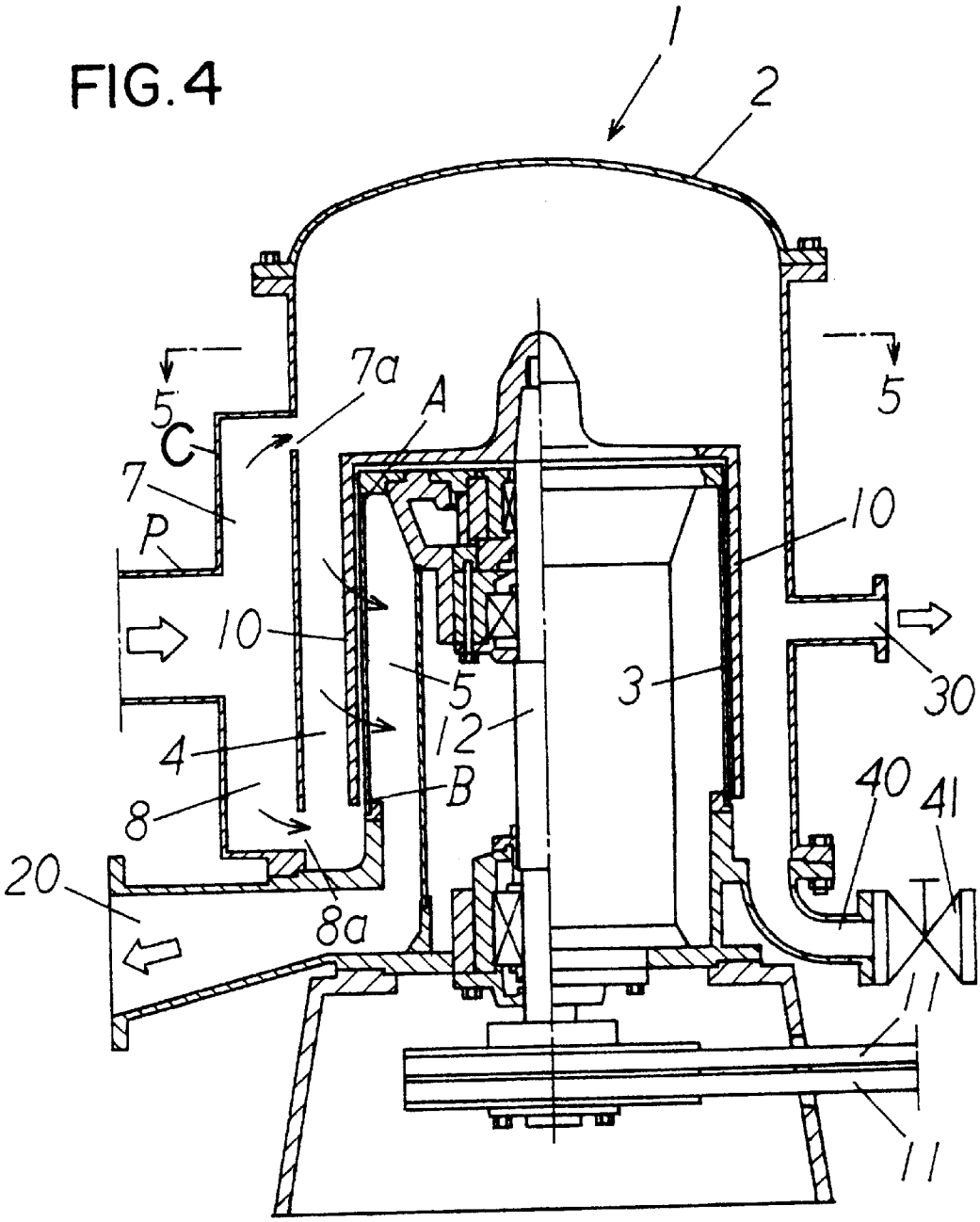
FIG. 4 is a schematic sectional view of a screen apparatus of a still different embodiment of the invention.
Figure 5:
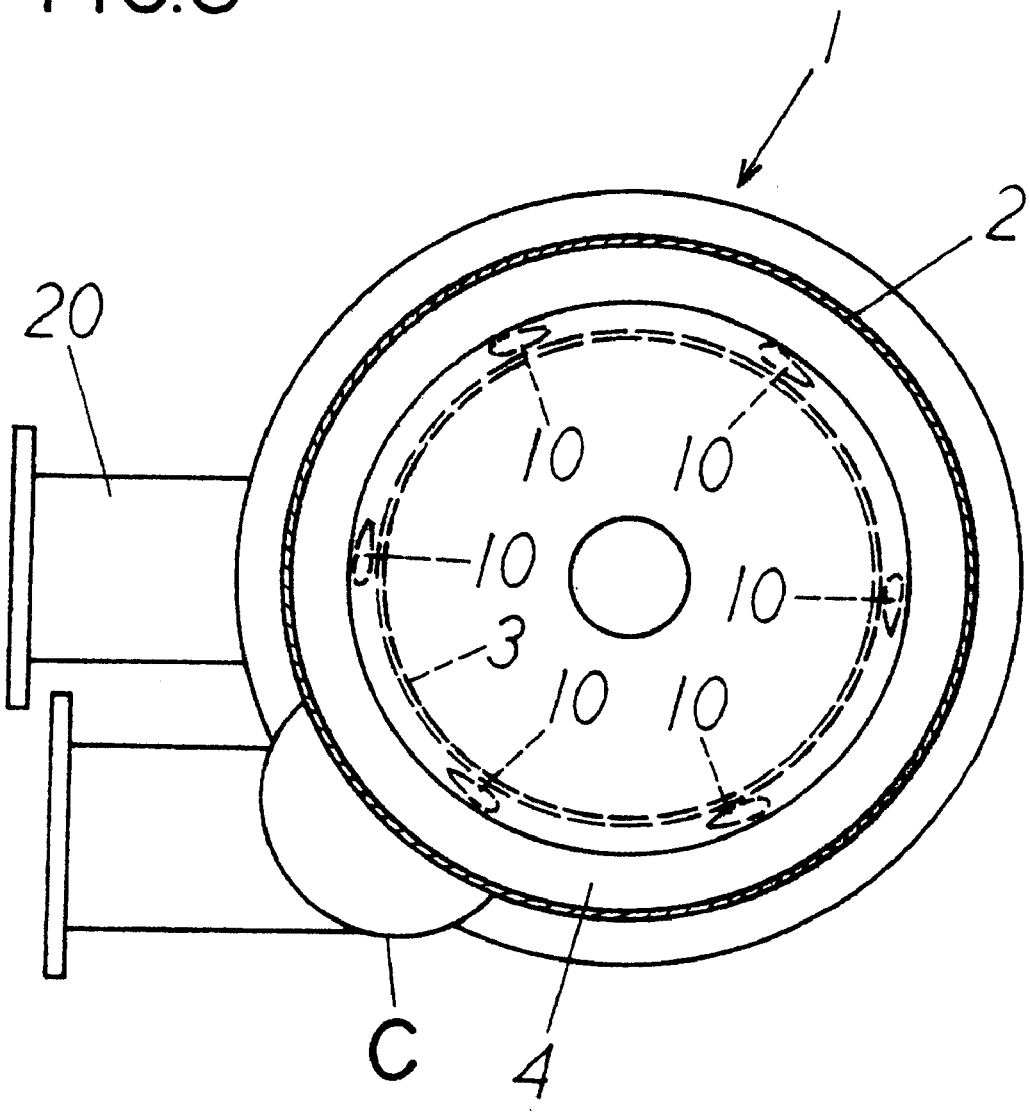
FIG. 5 is a schematic cross sectional view of the screen apparatus taken along line 5—5 in FIG. 4.

Also, although the first supply passage 7, the second supply passage 8, the third supply passage 7', and the fourth supply passage 8' are structured by pipes in the aforementioned embodiments of FIG. 1 through FIG. 3, the present invention is not limited to this structure. For example, as shown in FIGS. 4 and 5, an expanded portion C can be provided at the outside of the tank 2, and the first supply passage 7 and the second supply passage 8 are disposed inside the expanded portion C. Also, the first supply inlet 7*a* and the second supply inlet 8*a* may be provided respectively at the distal ends of the first supply passage 7 and the second supply passage 8 to face the tank 2.

In short, in the present invention, it is sufficient, in addition to the first supply passage 7, to provide at least the second supply passage 8, which supplies the papermaking material into the tank 2 and includes the second supply inlet 8*a* located lower than the first supply inlet 7*a* in the tank 2.

Also, in the aforementioned embodiments of FIG. 1 through FIG. 3, since the first supply inlet 7*a*, the second supply inlet 8*a*, the third supply inlet 7*a*' and the fourth supply inlet 8*a*' are respectively positioned to face the screen 3, the papermaking materials supplied from the first supply inlet 7*a*, the second supply inlet 8*a*, the third supply inlet 7*a*' and the fourth supply inlet 8*a*' directly hit the screen 3, so that the screen 3 may be damaged due to the impact of the papermaking material in some case.

In order to prevent the above incident, as shown in FIG. 4 and FIG. 5, the first supply inlet 7*a* is located higher than the uppermost openings A of the screen 3 such that the first supply inlet 7*a* does not oppose to the uppermost openings A of the screen 3. Thus, the papermaking material supplied from the first supply inlet 7*a* does not directly hit the screen 3 near the uppermost openings A, to thereby prevent the damage of the screen 3 due to the impact of the papermaking material.

Also, the second supply inlet 8*a* is located lower than the lowermost openings B of the screen 3 such that the second supply inlet 8*a* does not oppose to the lowermost openings B of the screen 3. Accordingly, the papermaking material supplied from the second supply inlet 8*a* does not directly hit the screen 3 near the lowermost openings B, to thereby prevent the damage of the screen 3 by the impact of the papermaking material.

Similarly to the aforementioned embodiments, foreign substances, which are stored in the first chamber 4 and can not pass through the screen 3, are led to the outside of the tank 2 through the foreign substance discharge passage 30, but as shown in FIG. 4 and FIG. 5, a connection position of the foreign substance discharge passage 30 to the tank 2 is located, in height, between the first supply inlet 7*a* and the second supply inlet 8*a*, and more preferably, located at a central part of the screen 3 in height. Also, numeral 40 designates a passage for discharging heavy foreign substances in the tank 2, and the passage 40 is provided with an opening and closing valve 41. The opening and closing valve 41 is adequately opened or closed to discharge the heavy foreign substances in the tank 2 to the outside of the tank 2.

Incidentally, the aforementioned embodiments may have the disadvantages, such that a flow of the papermaking material, which contains a large number of good fibers and is supplied from the first supply inlet 7*a* to flow toward the lower part of the tank 2, and a flow of the papermaking material, which contains a lot of foreign substances and moves toward the foreign substance discharge passage 30, collide with each other, to thereby lower a screen efficiency. Similarly, a flow of the papermaking material, which contains a large number of good fibers and is supplied from the second supply inlet 8*a* to flow toward the upper part of the tank 2, and a flow of the papermaking material, which contains a lot of foreign substances and moves toward the foreign substance discharge passage 30, collide with each other, to thereby a lower screening efficiency.

Embodiments shown in FIG. 6 through FIG. 11 improve the above disadvantage, and numeral 30*a* designates a foreign substance discharge outlet of the foreign substance discharge passage 30, which is located, in height, between the first supply inlet 7*a* and the second supply inlet 8*a* and communicates with the first chamber 4. In the foreign substance discharge passage 30, an opening and closing valve 31 for controlling a reject amount is disposed, and it is arranged such that an opening degree of the opening and closing valve 31 is adequately adjusted in accordance with the kind of the papermaking material or the like.

Figure 6:
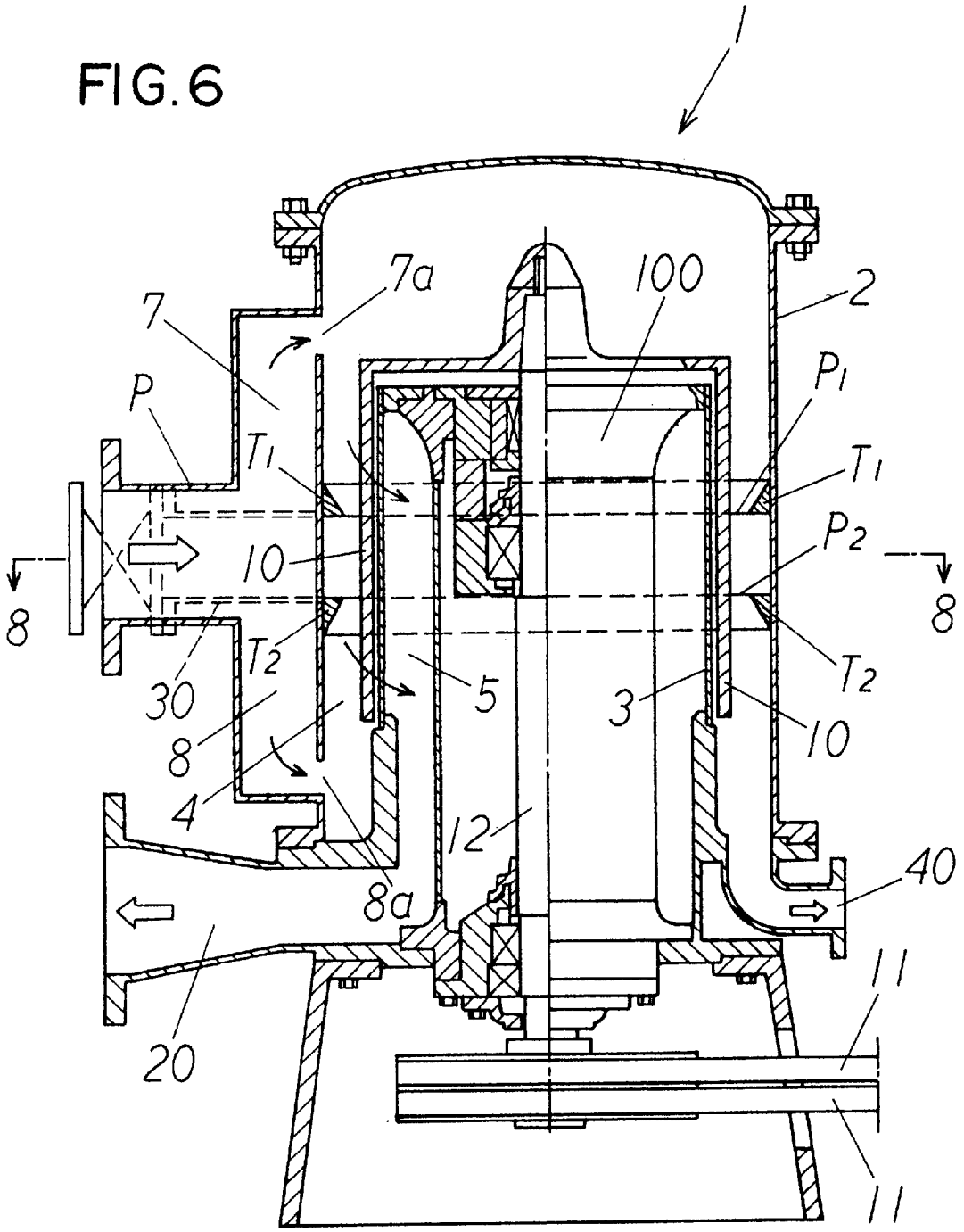
FIG. 6 is a schematic sectional view of a screen apparatus of a still different embodiment of the invention.
Figure 7:
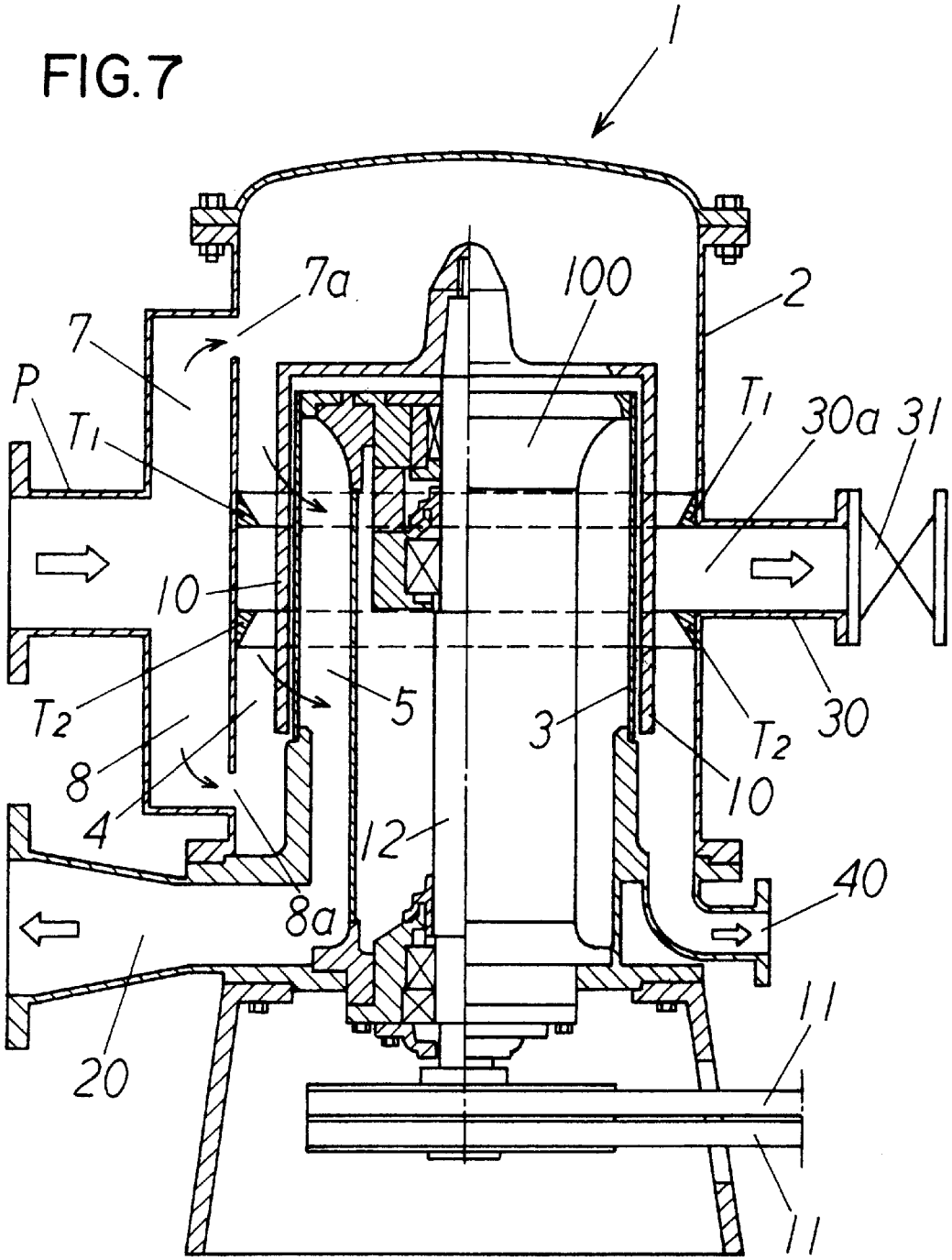
FIG. 7 is a schematic sectional view showing that a foreign substance discharge passage in FIG. 6 is rotated by 180 degrees for explanation.

An upper-side projecting member $T_1$ is located above the foreign substance discharge outlet 31, and is projected from an inner wall surface of the tank 2 to be circularly formed in the inner wall of the tank 2. Preferably, as shown in FIG. 6 and FIG. 7, the upper-side projecting member $T_1$ is provided to extend an entire periphery of the inner wall surface of the tank 2. As described above, the upper-side projecting member $T_1$ is located above the foreign substance discharge outlet 30*a* to narrow a passage or area $P_1$ in which the papermaking material supplied from the first supply inlet 7*a* flows toward the foreign substance discharge outlet 30*a*. Thus, the papermaking material, which is supplied from the first supply inlet 7*a* to flow toward the lower part of the tank 2 and contains a lot of good fibers, and the papermaking material, which flows toward the foreign substance discharge outlet 30*a* and contains a lot of foreign substances, are prevented from colliding with each other, to thereby improve the screening efficiency.

Figure 8:
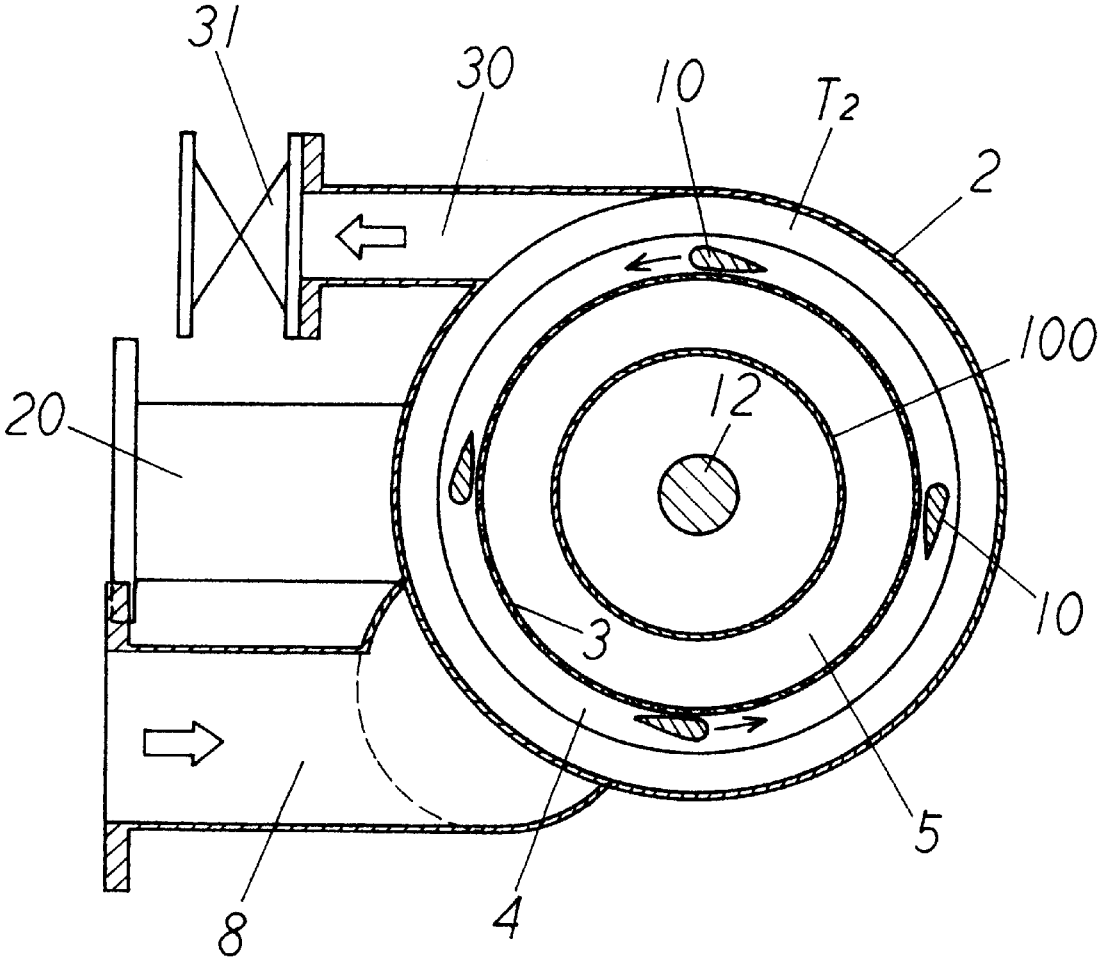
FIG. 8 is a schematic cross sectional view of the screen apparatus taken along line 8—8 in FIG. 6.

Also, a lower-side projecting member $T_2$ is located below the foreign substance discharge outlet 30*a*, and is projected from the inner wall surface of the tank 2 to be formed circularly on the inner wall of the tank 2. More preferably, as shown in FIGS. 6–8, the lower-side projecting member $T_2$ is provided to extend the entire periphery of the inner wall surface of the tank 2. As described above, the lower-side projecting member $T_2$ is disposed below the foreign substance discharge outlet 30*a* to narrow a passage or area $P_2$ in which the papermaking material supplied from the second supply inlet 8*a* flows toward the foreign substance discharge outlet 30*a*. Therefore, the papermaking material, which is supplied from the second supply inlet 8*a* to flow to the upper part of the tank 2 and contains a lot of good fibers, can be prevented from colliding with the papermaking material, which flows to the foreign substance discharge outlet 30*a* and mainly contains foreign substances, to thereby improve the screening efficiency.

Incidentally, since a kind of a chamber, i.e. reject chamber, is formed between the upper-side projecting member $T_1$ and the lowerside projecting member $T_2$, the foreign substances entered between the upper-side projecting member $T_1$ and the lower-side projecting member $T_2$ are led toward the foreign substance discharge outlet 30*a*, so that the foreign substances can be efficiently collected and ejected through the foreign substance discharge outlet 30*a*.

Figure 9:
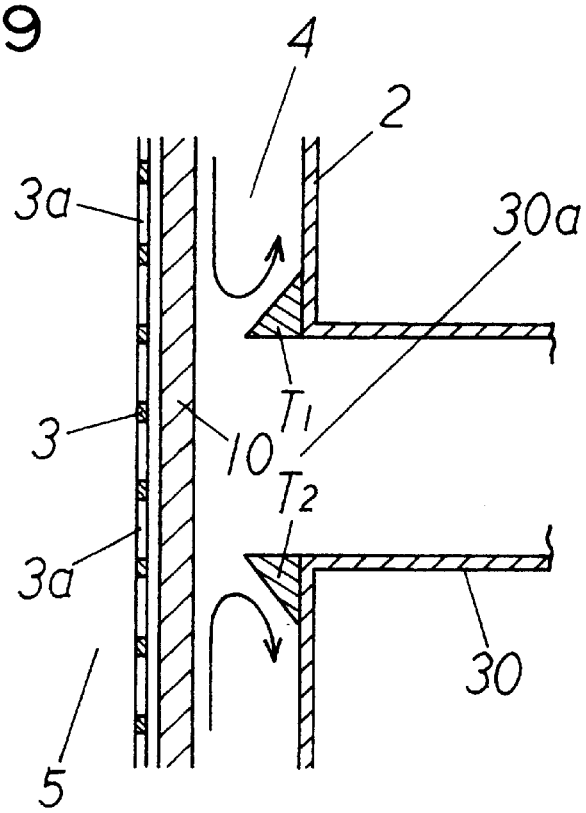
FIG. 9 is a schematic enlarged sectional view of a part of the foreign substance discharge outlet in FIG. 7.
Figure 10:
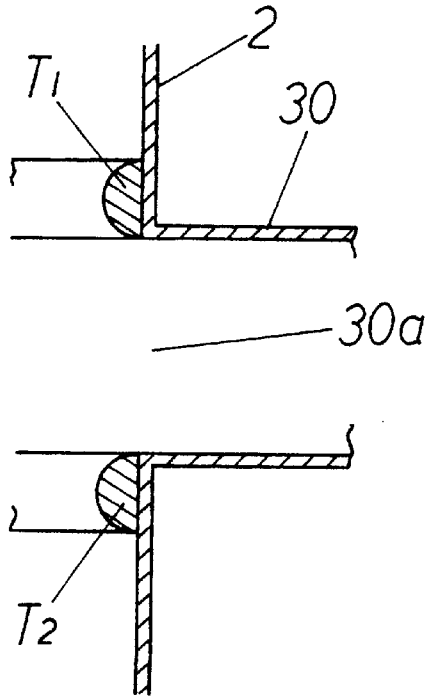
FIG. 10 is a schematic enlarged sectional view showing another embodiment of upper-side and lower-side projecting members.
Figure 11:
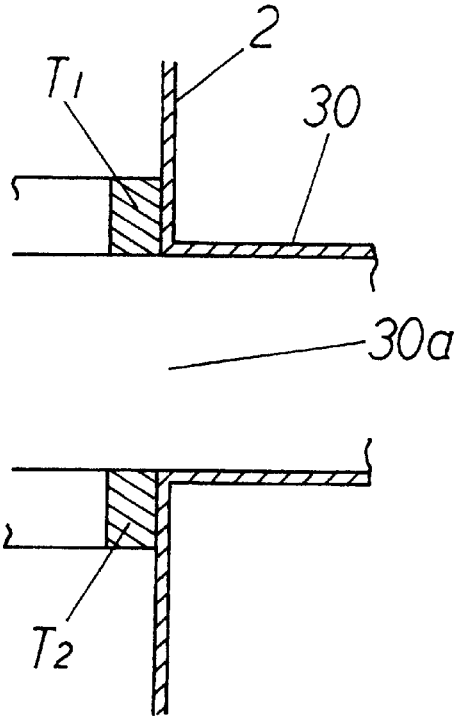
FIG. 11 is a schematic enlarged sectional view showing a still another embodiment of the upper-side and lower-side projecting members.

The upper-side projecting member $T_1$ and the lower-side projecting member $T_2$ may have sectional shapes shown in FIGS. 9–11. However, more preferably, as shown in FIG. 9 and FIG. 10, the upper-side projecting member $T_1$ is inclined such that an amount projecting from the inner wall surface of the tank 2 is decreased toward the upper side of the tank 2, and the lower-side projecting member $T_2$ is inclined such that an amount projecting from the inner wall surface of the tank 2 is decreased toward the lower side of the tank 2.

Namely, the papermaking material, which is supplied from the first supply inlet 7*a* to flow toward the lower part of the tank 2 and contains good fibers, hits the upper-side projecting member $T_1$ as shown by an arrow in FIG. 9, and is guided to the upper side of the tank 2 so as to form an upper-side internal circulation flow in the upper side of the tank 2. Also, similarly, since the lowerside projecting member $T_2$ is inclined such that a projecting amount from the inner wall surface of the tank 2 is decreased toward the lower side of the tank 2, the papermaking material, which is supplied from the second supply inlet 8*a* to flow toward the upper part of the tank 2 and contains good fibers, hits the lower-side projecting member $T_2$ and is guided to the lower side of the tank 2 so as to form a lower-side internal circulation flow. Thus, in the tank 2, the upper-side internal circulation flow and the lower-side internal circulation flow are formed, and screen efficiency and processing amount can be further improved.

Incidentally, numeral 40 designates a passage for discharging heavy foreign substances in the tank 2, and an opening and closing valve, not shown, is provided in the passage 40 to adequately open or close the opening and closing valve, so that the heavy foreign substances are discharged outside the tank 2.

Conventionally, as it approaches the lower part of the tank, that is, as the flow of the papermaking material reaches the downstream side (as the flow distance of the papermaking material from the supply inlet for papermaking material to the screen becomes long), the papermaking material is condensed, so that the separation effect by the screen is lowered. According to the screen apparatus of the first aspect of the invention, however, the supply passage for supplying the papermaking material to the tank is provided plurally as the first supply passage and the second supply passage, and moreover, the second supply inlet of the second supply passage into the tank is positioned lower than the first supply inlet of the first supply passage into the tank. Thus, the flow distance of the papermaking material from the supply inlet for the papermaking material to the screen is shortened, so that the papermaking material is prevented from condensed. As a result, a concentration or condensation of the papermaking material passing through the screen is lowered, and the material passing resistance of the screen becomes small, so that the papermaking material passing through the screen is increased to thereby improve the processing amount. Also, since the condensation of the papermaking material which passes through the screen is lowered, clogging of the screen is reduced, so that the effect of separating foreign substances and good fibers can be improved.

Also, according to the screen apparatus of the second and third aspects of the invention, in addition to the aforementioned effect of the first aspect of the preset invention, the first supply inlet is located higher than the openings at the uppermost part of the screen, and the second supply inlet is located lower than the opening at the lowermost part of the screen. Therefore, the papermaking material supplied from the first supply inlet does not directly hit the screen near the openings, so that damage of the screen due to the impact of the papermaking material can be prevented.

Further, according to the screen apparatus of the fourth aspect of the invention, in addition to the effect of the first aspect of the invention, since a kind of a chamber, that is, reject chamber, for collecting foreign substances is formed between the upper-side projecting member and the lower-side projecting member, foreign substances entered between the upper-side projecting member and the lower-side projecting member are guided toward the foreign substance discharge outlet, so that the foreign substances can be efficiently collected and discharged through the foreign substance discharge outlet.

Moreover, if the upper-side projecting member does not exist, the flow of the papermaking material, which is supplied from the first supply inlet to be flown toward the lower part of the tank and contains a lot of good fibers, and the flow of the papermaking material, which is flown toward the foreign substance discharge outlet and contains a lot of foreign substances, collide with each other to lower screening efficiency. Also, similarly, if the lower-side projecting member does not exist, the flow of the papermaking material, which is supplied from the second supply inlet to be flown toward the upper part of the tank and contains a lot of good fibers, and the flow of the papermaking material, which is flown toward the foreign substance discharge outlet and contains a lot of foreign substances, collide with each other to lower screening efficiency.

In the screen apparatus according to the fourth aspect of the invention, however, the upper-side projecting member is positioned above the foreign substance discharge outlet to narrow the passage or area in which the papermaking material supplied from the first supply inlet flows toward the foreign substance discharge outlet, so that the papermaking material, which flows toward the lower part of the tank and contains a lot of good fibers, is prevented from colliding with the papermaking material which flows toward the foreign substance discharge outlet and contains a lot of foreign substances. Also, the lower-side projecting member is positioned below the foreign substance discharge outlet to narrow the passage or area in which the papermaking material supplied from the second supply inlet flows toward the foreign substance discharge outlet, so that the papermaking material, which flows toward the upper part of the tank and contains a lot of good fibers, is prevented from colliding with the papermaking material which flows toward the foreign substance discharge outlet and contains a lot of foreign substances. Accordingly, screening efficiency can be improved.

Still further, according to the screen apparatus of the fifth aspect of the invention, in addition to the effect of the fourth aspect of the invention, since the upper-side projecting member is inclined such that the amount projecting from the inner wall surface of the tank is decreased toward the upper side of the tank, the papermaking material which hits the upper-side projecting member is guided toward the upper side of the tank to form the upper-side internal circulation flow. Also, similarly, since the lower-side projecting member is inclined such that the amount projecting from the inner wall surface of the tank is decreased toward the lower side of the tank, the papermaking material which hits the first lower-side projecting member is guided toward the lower side of the tank to form the lower-side internal circulation flow in the lower side of the tank. Thus, in the tank, the upper-side internal circulation flow and the lower-side internal circulation flow are formed, and screening efficiency and the process amount can be improved.

While the invention has been explained with reference to the specific embodiments of the invention, the explanation is illustrative and the invention is limited only by the appended claims.

What is claimed is:

1. A screen apparatus comprising:

a tank for receiving a papermaking material, a screen disposed inside the tank for dividing the tank into a first chamber and a second chamber and separating a foreign substance from the papermaking material, a first supply passage connected to the tank for supplying the papermaking material into the tank and including a first supply inlet located at an upper side of the tank, a second supply passage connected to the tank for supplying the papermaking material into the tank and including a second supply inlet located lower than the first supply inlet, a main supply passage communicating with the first and second supply passages so that the paper making material passing through the main supply passage is branched to the first and second supply passages, a stirring member disposed between an inner wall of the tank and the screen and stirring the papermaking material in the first chamber, a screened papermaking material discharge passage communicating with the second chamber and leading the papermaking material passing through the screen to an outside of the tank, and a foreign substance discharge passage communicating with the first chamber and leading the foreign substance separated from the papermaking material by the screen to the outside of the tank so that the papermaking material is supplied into the tank through the first and second supply passages; the papermaking material is stirred by the stirring member, the papermaking material passing through the screen is ejected to the outside of the tank through the screened papermaking material discharge passage; and the foreign substance contained in the papermaking material supplied to the tank and prevented from passing through the screen is ejected to the outside of the tank through the foreign substance discharge passage.

2. A screen apparatus according to claim 1, wherein said screen has openings for separating the foreign substance from the paper making material, and the first supply inlet is located higher than the openings of the screen to prevent the first supply inlet from directly facing the openings of the screen.

3. A screen apparatus according to claim 2, wherein the second supply inlet is located lower than the openings of the screen to prevent the second supply inlet from directly facing the openings of the screen.

4. A screen apparatus according to claim 1, wherein said foreign substance discharge passage includes a foreign substance discharge outlet located between the first supply inlet and the second supply inlet.

5. A screen apparatus according to claim 1, wherein said first chamber is located between the tank and the screen, and the second chamber is located inside the screen.

6. A screen apparatus according to claim 1, wherein the paper making material passing through the main supply passage and the first and second supply passages is ejected into the first chamber through the first and second supply inlets vertically spaced from each other.

7. A screen apparatus according to claim 6, wherein said upper projecting member is inclined such that an amount of an inward projection projecting inwardly from the inner wall of the tank is decreased toward an upper side of the tank, and said lower projecting member is inclined such that an amount of an inward projection projecting inwardly from the inner wall of the tank is decreased toward a lower side of the tank.

8. A screen apparatus comprising:

a tank for receiving a papermaking material and having an inner wall, a screen disposed inside the tank for dividing the tank into a first chamber and a second chamber and separating a foreign substance from the papermaking material, a first supply passage connected to the tank for supplying the papermaking material into the tank and including a first supply inlet located at an upper side of the tank, a second supply passage connected to the tank for supplying the papermaking material into the tank and including a second supply inlet located lower than the first supply inlet, a stirring member disposed between the inner wall of the tank and the screen and stirring the papermaking material in the first chamber, a screened papermaking material discharge passage communicating with the second chamber and leading the papermaking material passing through the screen to an outside of the tank, a foreign substance discharge passage having a foreign substance discharge outlet located between the first supply inlet and the second supply inlet to communicate with the first chamber, said foreign substance discharge passage leading the foreign substance separated from the papermaking material by the screen to the outside of the tank, an upper projecting member disposed above the foreign substance discharge outlet and projecting from the inner wall of the tank to extend at least partly circularly along the inner wall, and a lower projecting member disposed below the foreign substance discharge outlet and projecting from the inner wall of the tank to extend at least partly circularly along the inner wall.

* * * * *